US005887441A

United States Patent [19]

Spauschus et al.

[11] Patent Number: 5,887,441

[45] **Date of Patent: *Mar. 30, 1999**

[54] METHOD OF REMOVING AN IMMISCIBLE LUBRICANT FROM A REFRIGERATION SYSTEM AND APPARATUS FOR SAME

[75] Inventors: Hans O. Spauschus, Stockbridge; Thomas L. Starr, Roswell, both of Ga.

[73] Assignee: Spauschus Associates, Inc., Stockbridge, Ga.

[ * ] Notice: The term of this patent shall not extend beyond the expiration date of Pat. No. 5,636,520.

[21] Appl. No.: 845,955

[22] Filed: Apr. 30, 1997

Related U.S. Application Data

[62] Division of Ser. No. 570,779, Dec. 12, 1995, Pat. No. 5,636,520.

[51] Int. Cl.[6] ..... F25B 43/02

[52] U.S. Cl. ..... 62/84; 62/468

[58] Field of Search ..... 62/468, 470, 471, 62/195, 84, 85

[56] References Cited

U.S. PATENT DOCUMENTS 5,404,730 4/1995 Westermeyer ..... 62/470

5,636,520 6/1997 Spauschus et al. ..... 62/468

OTHER PUBLICATIONS

"Industrial Liquid Coalescers", Osmonics, Inc., 1990.

"Water Treatment Technology", B. Tramier, *Elf Aquitaine,* Petroleum Review, Oct. 1984.

*Primary Examiner*—John M. Sollecito
*Attorney, Agent, or Firm*—Jones & Askew, LLP

[57] ABSTRACT

A method of separating an immiscible lubricant from a liquid refrigerant in a refrigerating system including a compressor, a condenser, an expansion device and an evaporator, wherein the expansion device is connected to the condenser by a liquid refrigerant flow line for liquid refrigerant and immiscible lubricant. The method comprising slowing the rate of flow of the liquid refrigerant and immiscible lubricant between the condenser and the expansion device such that the liquid refrigerant and the immiscible lubricant separate based upon differences in density. The method also comprises collecting the separated immiscible lubricant in a collection chamber in fluid communication with the separated immiscible lubricant. Apparatus for performing the method is also disclosed.

15 Claims, 2 Drawing Sheets

METHOD OF REMOVING AN IMMISCIBLE LUBRICANT FROM A REFRIGERATION SYSTEM AND APPARATUS FOR SAME

This application is a divisional of U.S. patent application Ser. No. 08/570,779, filed Dec. 12, 1995, now U.S. Pat. No. 5,636,520.

This invention was made with Government support under Contract No. DE-FG02-91CE23810 awarded by The Department of Energy. The Government has certain rights in this invention.

FIELD OF THE INVENTION

The present invention relates generally to refrigeration systems, and, more specifically, to lubricants and refrigerants used in such systems. In particular, the present invention relates to a method of removing an immiscible lubricant from a refrigeration system. The present invention also relates to apparatus for removing an immiscible lubricant from a refrigeration system.

BACKGROUND OF THE INVENTION

Refrigeration systems are prevalent in our everyday life. Refrigeration systems can be found in such varied locations as automobiles, commercial and residential refrigerators and freezers, commercial and residential air conditioning systems, supermarket display cases and many other applications.

Vapor compression refrigeration systems typically comprise four elements: a compressor, a condenser, an expansion device and an evaporator. Refrigeration systems operate on the basis of a heat or thermodynamic cycle. In conventional refrigeration systems, a refrigerant is utilized which has a lower boiling point than the space which is to be cooled, i.e., have heat removed therefrom. In the evaporator, heat is passed through the evaporator coils to the liquid refrigerant which absorbs that heat as the heat of vaporization. The phase change of the refrigerant from a liquid to a gas which occurs in the evaporator carries the absorbed heat with it. The gaseous refrigerant is withdrawn from the evaporator by a compressor which then compresses the gaseous refrigerant. The compressed vapor is discharged from the compressor to the condenser. In the condenser, the refrigerant once again undergoes a phase change whereby the heat of vaporization is released to the condenser's surrounding. The refrigerant then condenses and changes from a gas to a liquid. The liquid refrigerant then is passed through an expansion device to the evaporator where the heat cycle begins again.

In order to lubricate the moving parts of a refrigeration system compressor, the refrigerant usually includes a lubricant. In chlorofluorocarbon refrigerants ("CFCs"), the conventional lubricant is mineral oil. The mineral oil is miscible with the liquid CFCs.

The phase out of CFC-12, under the terms of the 1987 Montreal Protocol on Substances that Deplete the Ozone Layer is effecting an immediate shift away from CFCs in refrigeration systems toward hydrofluorocarbon refrigerants ("HFCs"), such as HFC-134a, a substitute refrigerant with no ozone depletion potential. However, one may not merely substitute HFC-134a for CFC-12. When CFC-12 is removed from a refrigeration system, residual mineral oil remains in the system. When HFC-134a is added to such a system, it is not miscible with the mineral oil used to provide lubrication in the CFC-12 system. Due to this immiscibility, synthetic lubricants, such as, polyolesters, have been developed specifically to mix with HFC refrigerants and provide proper lubrication. Problems result from this immiscibility. At temperatures occurring in the evaporator, very little HFC-134a is dissolved in the mineral oil, resulting in a high viscosity lubricant that does not circulate. Instead, the mineral oil trapped in the evaporator interferes with refrigerant flow and heat transfer. Processes developed for removing mineral oil during a retrofit, i.e., a change from one refrigerant to another, have been developed. The prevailing "triple flush" procedure safely and efficiently removes mineral oil from the system. The "triple flush" procedure comprises diluting the mineral oil in large amounts of polyolester lubricant. Repeated replacement of the compressor lubricant after periods of system operation result in progressively lower mineral oil levels. Although the "triple flush" procedure is effective, it has high costs associated with lubricant, waste disposal and technician labor.

Opinions differ widely on how much residual mineral oil is acceptable after retrofit. Recommendations from compressor manufacturers and refrigerant manufacturers range from 1% to 8%. While the differences between these values may not seem large, reducing the residual oil content from 8% to 1% may involve a significant effort and cost. Accordingly, there is a significant need for an apparatus and a method of removing immiscible lubricants, such as mineral oil, from refrigeration systems in both an effective and a relatively economical manner.

SUMMARY OF THE INVENTION

The present invention satisfies the above-described needs by providing a method of separating an immiscible lubricant from a liquid refrigerant in a refrigeration system including a compressor, a condenser, an expansion device and an evaporator, wherein the expansion device is connected to the condenser by a liquid refrigerant flow line for liquid refrigerant and immiscible lubricant. The method comprises slowing the rate of flow of the liquid refrigerant and immiscible lubricant between the condenser and the expansion device such that the liquid refrigerant and the immiscible lubricant separate based upon their differences in density. The method also comprises collecting the separated immiscible lubricant in a collection chamber in fluid communication with the separated immiscible lubricant.

In another embodiment, the present invention comprises a method of separating an immiscible lubricant from a liquid refrigerant in a refrigeration system including a compressor, a condenser, an expansion device and an evaporator, the expansion device being connected to the condenser by a liquid refrigerant flow line for liquid refrigerant and immiscible lubricant. The method comprises diverting at least a portion of the flow of the refrigerant and immiscible lubricant from the liquid refrigerant flow line through a by-pass line. At least a portion of the by-pass line provides a substantially horizontal path for the flow of the refrigerant and immiscible lubricant. The flow of refrigerant and immiscible lubricant in the by-pass line is at a speed and for a period of time sufficient to permit the liquid refrigerant and the immiscible lubricant to separate based upon their differences in density. The method also comprises collecting the separated immiscible lubricant in a collection chamber in fluid communication with the horizontal path and vertically displaced from the horizontal path.

In an alternate embodiment, the present invention comprises an apparatus for separating an immiscible lubricant from a liquid refrigerant in a refrigeration system which includes a liquid refrigerant flow line from a condenser to an expansion device. The apparatus comprises a by-pass line connected to the liquid refrigerant flow line. The by-pass line diverts at least a portion of the refrigerant and immiscible lubricant flowing in the liquid refrigerant flow line. At least a portion of the by-pass line provides a substantially horizontal path for the flow of the refrigerant and immiscible lubricant. The apparatus also includes a collection chamber for separated immiscible lubricant. The collection chamber is in fluid communication with the horizontal portion of the by-pass line and is vertically displaced from the by-pass line, such that as the liquid refrigerant and immiscible lubricant flow through the horizontal portion of the by-pass line at a speed and for a period of time sufficient to permit the liquid refrigerant and the immiscible lubricant to separate based upon their differences in density the immiscible lubricant is collected in the collection chamber.

Accordingly, it is an object of the present invention to provide an improved method and apparatus for removing an immiscible lubricant from a liquid refrigerant in a refrigeration system.

Another object of the present invention is to provide a method of retrofitting a refrigeration system containing an environmentally undesirable refrigerant, such as a chlorofluorocarbon refrigerant, with a hydrofluorocarbon refrigerant, or other environmentally friendly refrigerant, which is not miscible with the lubricant associated with the undesirable refrigerant.

A further object of the present invention is to provide a method and apparatus for removing an immiscible lubricant from a liquid refrigerant in a refrigeration system which is more economical than present methods.

Still another object of the present invention is to provide a method and apparatus for removing residual immiscible mineral oil from a retrofit refrigeration system.

Yet another object of the present invention is to provide an apparatus for removing an immiscible lubricant from a liquid refrigerant in a refrigeration system which can be relatively easily installed in the refrigeration system on a temporary basis.

Another object of the present invention is to provide a method for separating an immiscible lubricant from a liquid refrigerant in a refrigeration system while the refrigeration system is in normal operation.

Still another object of the present invention is to provide a method and apparatus for retrofitting refrigeration systems with environmentally friendly refrigerants without the waste associated with flushing fluids.

These and other objects, features and advantages of the present invention will become apparent after a review of the following detailed description of the disclosed embodiments and the appended drawing and claims.

DETAILED DESCRIPTION OF THE DISCLOSURE EMBODIMENTS

Figure 1:
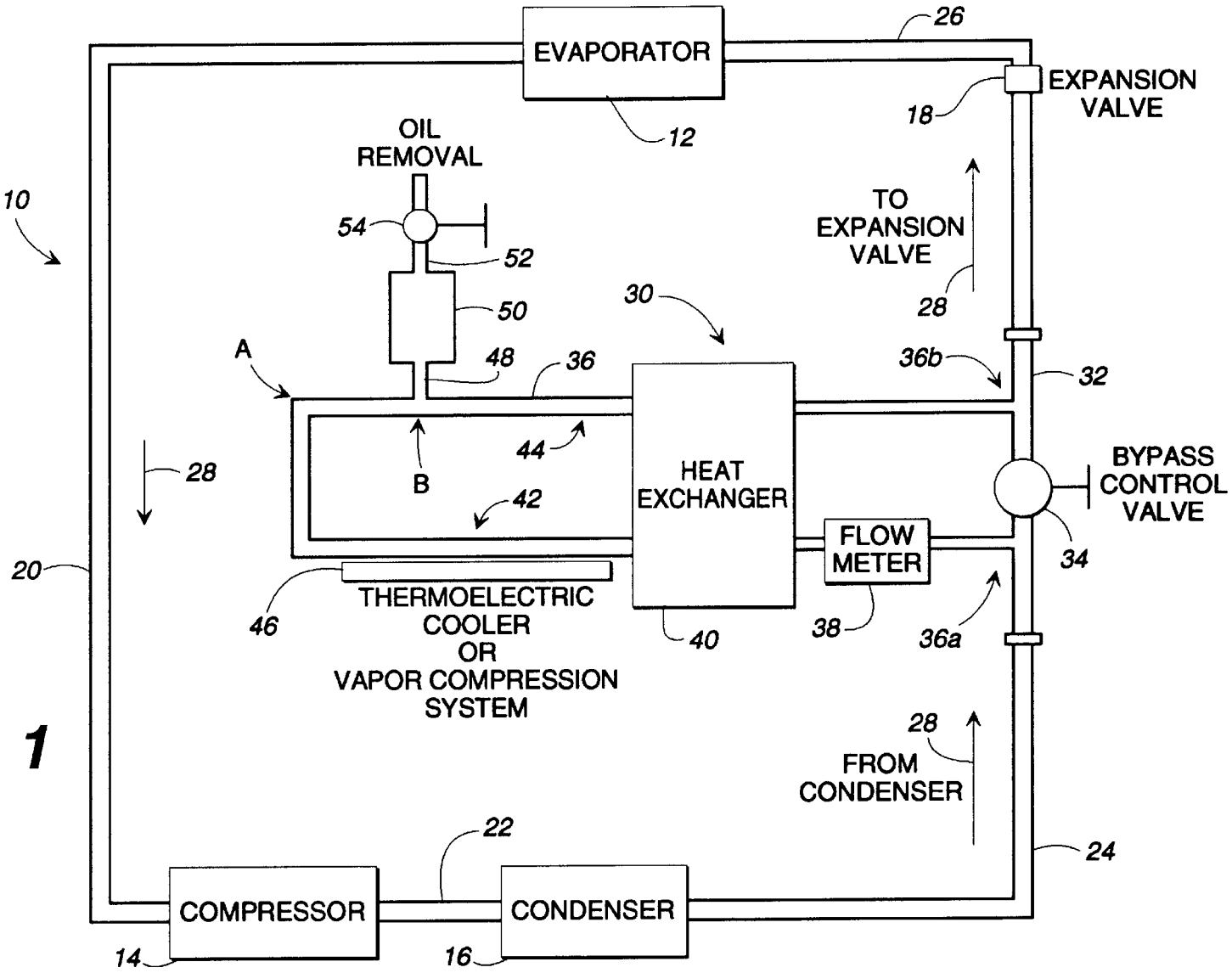
FIG. 1 is a schematic view of a disclosed embodiment of the refrigeration system of the present invention.

With reference to the drawing in which like numbers indicate like elements throughout the several views, it can be seen that there is a refrigeration system 10 comprising an evaporator 12, a compressor 14, a condenser 16 and an expansion device 18. The evaporator 12 is connected to the compressor 14 by a pipe 20. The compressor 14 is connected to the condenser 16 by a pipe 22. The condenser 16 is connected to the expansion device by a pipe 24. The expansion device 18 is connected to the evaporator 12 by a pipe 26. A refrigerant and a lubricant are circulated around the refrigeration system 10 in the direction shown by the arrows 28.

The foregoing elements 12 through 26 comprise a conventional vapor compression-type refrigeration system. Such vapor compression-type refrigeration systems are well known to those skilled in the art and it is believed that no further explanation of the construction or operation of such a system is necessary.

The refrigeration system 10 contains a refrigerant and a lubricant which is miscible with the refrigerant. In the evaporator 12, heat is passed from the surroundings through the evaporator coils to the liquid refrigerant within the evaporator coils which absorbs that heat as the heat of vaporization. The absorption of this heat causes the refrigerant to boil and change from a liquid to a gas. The phase change of the refrigerant from a liquid to a gas which occurs in the evaporator 12 carries the absorbed heat with it. The gaseous refrigerant is withdrawn from the evaporator 12 through the pipe 20 by the compressor 14 which then compresses the gaseous refrigerant to a higher pressure. The compressed vapor is discharged from the compressor 14 to the condenser 16 through the pipe 22. In the condenser 16, the refrigerant once again undergoes a phase change whereby the heat of vaporization is released to the condenser's surrounding. This release of heat in the condenser 16 causes the refrigerant to condense and change from a gas to a liquid. The liquid refrigerant then is passed from the condenser 16 to the expansion device 18 through the pipe 24. The liquid refrigerant then is passed through the expansion device 18 to the evaporator 12 through the pipe 26 where the heat cycle begins again.

Since the lubricant contained in the refrigeration system 10 is miscible with the refrigerant, a small quantity of the lubricant flows through the refrigeration system along with the refrigerant in the direction shown by the arrows 28.

When changing over from one refrigerant to another refrigerant, such as a change from a CFC refrigerant to an HFC refrigerant, the lubricant associated with the old refrigerant may not be miscible with the new refrigerant. For example, the most common lubricant for CFC refrigerants is mineral oil. However, mineral oil is not miscible with HFC refrigerants, such as R-134a. Therefore, unless the refrigeration system 10 is thoroughly flushed of the old lubricant, residual lubricant which may not be miscible with the new refrigerant may be present in a retrofit refrigeration system.

Table 1 below shows several lubricants which are typically associated with CFC refrigerants:

TABLE 1

| Material | Viscosity (cSt) | Density ($G/cm^3$) |
|---|---|---|
| Naphthenic mineral oil | 33.1 | 0.913 |
| | 61.9 | 0.917 |
| | 68.6 | 0.9 |
| Paraffinic mineral oil | 34.2 | 0.862 |
| Alkylbenzene | 31.7 | 0.872 |

The lubricants in Table 1 are likely candidates for residual oils with retrofit refrigerants. Table 2 below illustrates some typical HFC retrofit refrigerants:

TABLE 2

| Material | Formula | Density @ 25° C. ($g/cm^3$) |
|---|---|---|
| R-125 | $HC_2F_5$ | 1.18 |
| R-134-a | $H_2C_2F_4$ | 1.20 |

All of the lubricants shown in Table 1 are immiscible with the refrigerants shown in Table 2. Therefore, when a refrigeration system containing a lubricant from Table 1 is retrofitted with a refrigerant from Table 2, there will be left residual immiscible lubricant from Table 1 in the refrigeration system if the system is not flushed completely. However, the present invention provides a system by which the immiscible lubricant need not be completely removed by flushing.

For illustration purposes, assume that the refrigeration system 10 contains CFC-12 refrigerant and a mineral oil lubricant. The refrigeration system 10 can be retrofitted with HFC-134a refrigerant and a polyolester lubricant (for example, Mobil Arctic 22 available from Mobil Oil) in accordance with the present invention without flushing the system, as described below.

First, a pump (not shown) is attached to the refrigeration system 10 in a manner well known to those skilled in the art to "pump down" and recover the CFC-12 refrigerant. Then, the mineral oil lubricant is drained from the compressor 14 using conventional techniques which are also well known to those skilled in the art. If the refrigeration system has an oil separator (not shown), the mineral oil should be drained from the separator as well. No further flushing or washing of the refrigeration system 10 is necessary.

The pipe 28 from the condenser 16 to the expansion device 18 is cut and a temporary by-pass system 30 is installed in-line with the pipe 28. If the refrigeration system utilizes a removable liquid-line filtration unit (not shown), the fittings used for this purpose may be used to install the by-pass system. The temporary by-pass system 30 comprises a pipe 32 having a by-pass control valve 34 installed therein. Attached to the pipe 32 is a pipe 36 formed into a loop. One end 36*a* of the by-pass loop 36 is attached to the pipe 32 upstream of the by-pass control valve 34 and the other end of the loop 36*b* is attached to the pipe 32 downstream of the by-pass control valve. Optionally installed in the by-pass loop 36 is a flow meter 38 and a heat exchanger 40. The heat exchanger 40 can be of any conventional design known to those skilled in the art, so that heat from the lower leg 42 of the by-pass loop 36 is transferred to the upper leg 44 of the by-pass loop, such as by contact heat transfer or by convective heat transfer. Advantageously, installed in the by-pass loop 36 is a cooling unit 46. The cooling unit 46 can be of any conventional design known to those skilled in the art for removing heat from the fluid in the lower leg 42 of the pipe 36, such as a thermoelectric cooler or a vapor system.

Connected to the pipe 36 is a stand pipe 48 which in turn is connected to a lubricant collection chamber 50. The lubricant collection chamber 50 is connected to a lubricant extraction pipe 52 which includes a valve 54.

The portion of the upper leg 44 of the pipe 36 from the point designated at "A" and the point designated at "B" is substantially horizontal. By substantially horizontal is meant that the flow of the fluid through the pipe 36 between "A" and "B" has enough of a horizontal component that fluids having different specific gravities or densities will at least partially separate during the time it takes the fluid to travel from point "A" to point "B."

The lubricant collection chamber 50 is in fluid communication with the pipe 36 through the lubricant extraction pipe 52 so that a fluid of a lower density floating on a fluid of a higher density will rise into the collection chamber as the fluids pass point "B." The valve 54 permits withdrawal of lubricant from the lubricant collection chamber 50.

The operation of the refrigeration system 10 will now be considered. After the refrigeration system 10 has been "pumped down," the mineral oil lubricant drained from the compressor 14 and the temporary by-pass system 30 is attached to the pipe 24 as described above, a polyolester lubricant is then added to the compressor 14. The residual mineral oil lubricant may constitute from approximately 10% to 50% by weight of the lubricant in the refrigeration system 10. The system is then charged with HFC-134a refrigerant in a manner well known to those skilled in the art. The compressor 14 is then turned on so that the refrigeration system 10 begins normal operation. The by-pass control valve 34 is then adjusted so that a portion of the refrigerant and lubricant in the system 10 is circulated through the by-pass loop 30. Adjustment of the by-pass control valve 34 is facilitated by reference to the flow meter 38.

The liquid flowing through the by-pass loop 36 comprises a mixture of HFC-134a refrigerant and polyolester lubricant. Since the HFC-134a refrigerant and polyolester lubricant are miscible, the refrigerant is dissolved in the lubricant to form a uniform solution. However, since the residual mineral oil lubricant is not miscible with the HFC-134a refrigerant and polyolester lubricant solution, the mineral oil remains in a separate liquid phase, such as in a liquid/liquid phase dispersion wherein the HFC-134a refrigerant and polyolester lubricant solution is the continuous phase and the mineral oil lubricant is the discontinuous phase.

Due to the differences in the densities of the HFC-134a refrigerant and polyolester lubricant solution and the mineral oil lubricant, the refrigerant-lubricant/mineral oil dispersion is unstable. Under the influence of gravity, the two liquid phases will begin to separate into separate liquid layers with the lighter phase, i.e., less dense phase, floating to the top and the heavier phase, i.e., more dense phase, sinking to the bottom of its container. The separation of the two phases is a function of the speed of flow of the dispersion. The by-pass loop 30 is therefore designed to reduce the speed of flow of the dispersion through the pipe 36. Due to the reduced speed of the flow of the dispersion through the pipe 36, the liquid HFC-134a refrigerant and polyolester lubricant solution begins to separate into a separate layer from the mineral oil phase. Since the density of the refrigerant is 1.20 $g/cm^3$ at 25° C. and the density of the mineral oil is between approximately 0.862 and 0.917 $g/cm^3$ at 25° C., the mineral oil phase will float to the top of the refrigerant and polyolester lubricant mixture phase.

The miscibility of mineral oil in the liquid refrigerant phase is a function of temperature. Generally speaking, the more the refrigerant is cooled, the less miscible the mineral oil becomes. The separation of the two phases can therefore be facilitated by controlling the temperature of the liquids. For the particular materials involved, i.e., HFC-134a refrigerant and mineral oil lubricant, a decrease in the temperature of the dispersion will result in more complete phase separation. Therefore, as the dispersion flows through the pipe 36, it is advantageous to cool the dispersion to enhance phase separation using the cooling unit 46.

It is also advantageous to include a heat exchanger between the upper leg 44 and the lower leg 42 of the pipe 36. The liquid leaving the condenser 16 is either at ambient temperature of slightly higher. The liquid which is cooled by the cooling unit 46 is therefore cooled to a temperature below that of the liquid leaving the condenser. The amount of cooling provided by the cooling unit 46 is not critical to the present invention. Generally speaking, however, any amount of cooling decreases the miscibility of the mineral oil in the refrigerant and is desirable. Therefore, as the liquid flows through the pipe 36 some of the heat from the higher temperature liquid in the lower leg 42 is transferred to the lower temperature liquid in the upper leg 44 by the heat exchanger 40. The heat exchanger 40 performs two functions. It pre-chills the liquid in the pipe 36, thereby reducing the heat load on the cooling unit 46. It also warms the liquid in the upper leg 44 so that it does not upset the thermal balance of the overall refrigeration system.

The speed of the flow of the dispersion through the pipe 36 is a function of the amount of dispersion diverted from the flow through the pipe 24 by the by-pass valve 34. It is also a function of the size of the pipe 36. Generally speaking, any amount of dispersion diverted through the by-pass loop 30 is sufficient. Preferably, however, the by-pass control valve 34 is adjusted so that approximately 5%, of the refrigerant and lubricant in the system is circulated through the by-pass loop 30. The size of the pipe 36 is dependent upon the amount of flow diverted through it. However, generally speaking the pipe 36 should not generally be less than one-fourth the internal volume of the pipe 32. The pipe 36 can, of course, be larger in diameter than the pipe 32.

Figure 2:
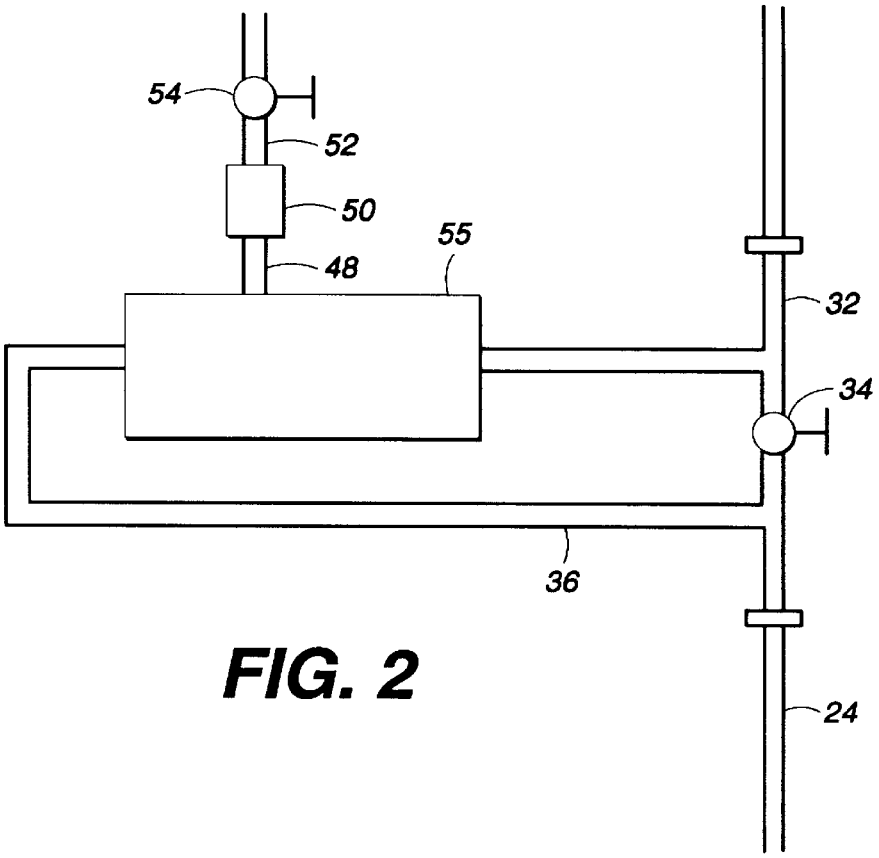
FIG. 2 is a schematic view of an alternate disclosed embodiment of the temporary by-pass system of the present invention.

Alternately, the pipe 36 can include a portion of significantly increased diameter. As shown in FIG. 2, the pipe 36 includes a chamber 55 of significantly increased diameter with respect to the diameter of the pipe 32. As the liquid flows from left to right through the chamber 55 shown in FIG. 2, its speed will be significant reduced compared to the speed of the flow through the pipe 32.

As the liquid dispersion flows through the pipe 36, it separates into layers of different densities. The portion of the pipe 36 between the points "A" and "B" is substantially horizontal so that the lighter layer can rise to the top of the dispersion. When that lighter layer reaches the extraction pipe 48 it floats upwardly into the collection chamber 50. The collection chamber 50 provides a reservoir so than a relatively large amount of immiscible lubricant can be collected from the system. When the collection chamber 50 has collected a desired amount of immiscible lubricant, it can be emptied by opening the valve 54.

In certain instances, it may occur that the lubricant has a higher density than the refrigerant. In those cases, the more dense lubricant would sink to the bottom and the lighter refrigerant would rise to the top of the liquid dispersion. In those cases, it should be understood that the lubricant collection chamber 50 would be located below the pipe 36 instead of above the pipe so that the heavier lubricant could sink into the lubricant collection chamber.

Figure 3:
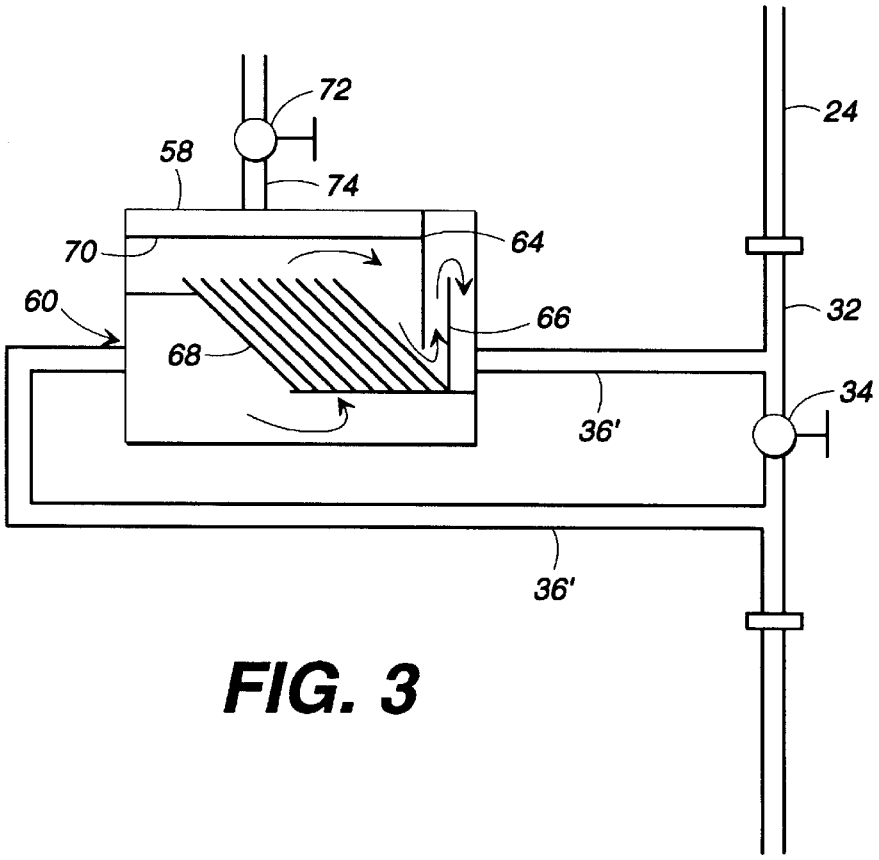
FIG. 3 is a schematic view of another alternate disclosed embodiment of the temporary by-pass system of the present invention.

With reference to FIG. 3, there will be seen an alternate disclosed embodiment of the by-pass loop 30. There is shown a pipe 36' connected to the pipe 32 to form a loop having the end 36*a'* connected to the pipe 36 upstream of the end 36*b'* with respect to the flow of liquid refrigerant through the pipe 24 from the condenser to the expansion device 18. Connected in-line with the pipe 36' is an oil separator chamber 56. The oil separator chamber 56 comprises a housing 58 having an inlet 60 and an outlet 62. The internal diameter of the oil separator chamber 56 is significantly greater than that of the pipe 36'. Therefore, the speed of flow of the dispersion through the oil separator chamber 56 will be significantly less than through the pipe 36'.

Within the housing 58 is a downwardly extending baffle plate 64 and an upwardly extending baffle plate 66. Between the inlet 60 and the baffle plate 64 are a plurality of coalescer plates 68. The purpose of the coalescer plates 68 is to assist the collision of oil, i.e., lubricant, particles to form larger ones which rise more rapidly. The coalescer plates 68 may be either of two designs: plate design (interceptors) or porous medium design (coalescers). The coalescer depicted in FIG. 3 is of the plate design.

The refrigerant and lubricant dispersion from the pipe 36' enters the oil separator chamber 56 through the inlet 60. The dispersion flows upwardly through the coalescer plates 68. While the dispersion is flowing between the parallel plates 68, the small lubricant dispersion droplets collide with each other and form larger droplets. When the dispersion flow emerges from the top of the coalescers 68, the larger droplets of lubricant float to the top of the dispersion more easily and rapidly than would smaller droplets. The larger droplets of lubricant collect at the top of the oil separator chamber 56 and form a separate layer of lubricant 70. The layer of lubricant 70 can be removed by opening the valve 72 on the pipe 74 which is in fluid communication with the layer of lubricant. The refrigerant portion of the dispersion, i.e., refrigerant and lubricant solution, flows under the baffle 64 and over the baffle 66 to the outlet 62 of the oil separator chamber 56. The fluid which emerges from the oil separator chamber 56 thereby has significantly reduced levels of immiscible lubricant entrained therein.

By its design, the present invention will continue to remove the residual immiscible lubricant until the concentration of the immiscible lubricant is below its miscibility limit with the particular liquid refrigerant. Depending on the particular refrigeration system, it is believed that the present invention can reduce the level of immiscible lubricant to below 1% by weight. Furthermore, as described above, the refrigeration system can remain in normal operation while the immiscible lubricant is being removed. After the desired amount of immiscible lubricant is removed from the refrigeration system 10, the by-pass system 30 can be removed and the pipe 24 reconnected.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A method of separating an immiscible lubricant from a liquid refrigerant in a refrigerating system comprising the steps of:

(a) flowing said refrigerant and immiscible lubricant through a substantially horizontal path at a speed and for a period of time sufficient to permit said liquid refrigerant and said immiscible lubricant to at least partially separate based upon their differences in density; and (b) collecting said separated immiscible lubricant in a collection chamber in fluid communication with said horizontal path and vertically displaced from said horizontal path.

2. The method of claim 1 further comprising the step of cooling said flowing refrigerant and immiscible lubricant prior to said separation.

3. The method of claim 1, wherein said flowing refrigerant and immiscible lubricant have a portion upstream of said collection chamber and a portion downstream of said collection chamber, said method further comprising the step of transferring heat from said upstream portion to said downstream portion.

4. The method of claim 1, wherein said flow of refrigerant and immiscible lubricant is a portion of the refrigerant and immiscible lubricant flowing between a condenser and an expansion device.

5. The method of claim 1, wherein said refrigerant comprises a hydrofluorocarbon refrigerant.

6. The method of claim 1, wherein said lubricant comprises mineral oil.

7. A method of separating an immiscible lubricant from a liquid refrigerant in a refrigerating system including a compressor, a condenser, an expansion device and an evaporator, said expansion device being connected to said condenser by a liquid refrigerant flow line for liquid refrigerant and immiscible lubricant, said method comprising the steps of:

(a) diverting at least a portion of said flow of said refrigerant and immiscible lubricant from said liquid refrigerant flow line through a by-pass line, at least a portion of said by-pass line providing a substantially horizontal path for said flow of said refrigerant and immiscible lubricant, said flow of refrigerant and immiscible lubricant in said by-pass line being at a speed and for a period of time sufficient to permit at least a portion of said liquid refrigerant and said immiscible lubricant to separate based upon their differences in density; and (b) collecting said separated immiscible lubricant in a collection chamber in fluid communication with said horizontal path and vertically displaced from said horizontal path.

8. Apparatus for separating an immiscible lubricant from a liquid refrigerant in a refrigerating system which includes a liquid refrigerant flow line from a condenser to an expansion device, said apparatus comprising:

(a) a by-pass line connected to said liquid refrigerant flow line, said by-pass line diverting at least a portion of the refrigerant and immiscible lubricant flowing in said liquid refrigerant flow line, at least a portion of said by-pass line providing a substantially horizontal path for the flow of said refrigerant and immiscible lubricant; and (c) a collection chamber for separated immiscible lubricant, said collection chamber being in fluid communication with said horizontal portion of said by-pass line and vertically displaced from said by-pass line, such that as said liquid refrigerant and immiscible lubricant flow through said horizontal portion of said by-pass line at a speed and for a period of time sufficient to permit at least a portion of said liquid refrigerant and said immiscible lubricant to separate based upon their differences in density, said separated immiscible lubricant is collected in said collection chamber.

9. The apparatus of claim 8 further comprising:

(a) a cooling unit operatively associated with said by-pass line so as to extract heat from said liquid refrigerant and immiscible lubricant flowing through said by-pass line prior to said horizontal portion of said by-pass line.

10. The apparatus of claim 9, wherein said cooling unit is a vapor compression refrigeration device.

11. The apparatus of claim 9, wherein said cooling unit is a thermoelectric refrigeration device.

12. The apparatus of claim 8, wherein said by-pass line includes a portion upstream of said collection chamber and a portion downstream of said collection chamber, said apparatus further comprising a heat exchanger operatively associated with said by-pass line so as to transfer heat from said upstream portion of said by-pass line to said downstream portion of said by-pass line.

13. The apparatus of claim 8 further comprising a valve for regulating the portion of the refrigerant and immiscible lubricant flowing in said liquid refrigerant flow line which is diverted to said by-pass line.

14. A refrigeration system comprising:

(a) an evaporator;

(b) a compressor connected to said evaporator;

(c) a condenser connected to said compressor;

(d) an expansion device connected to said condenser and to said evaporator, said connection between said condenser and said expansion device comprising a liquid refrigerant flow line;

(e) a by-pass line connected to said liquid refrigerant flow line, said by-pass line diverting at least a portion of the refrigerant and immiscible lubricant flowing in said liquid refrigerant flow line, at least a portion of said by-pass line providing a substantially horizontal path for the flow of said refrigerant and immiscible lubricant; and (f) a collection chamber for separated immiscible lubricant, said collection chamber being in fluid communication with said horizontal portion of said by-pass line and vertically displaced from said by-pass line, such that as said liquid refrigerant and immiscible lubricant flow through said horizontal portion of said by-pass line at a speed and for a period of time sufficient to permit said liquid refrigerant and said immiscible lubricant to at least partially separate based upon their differences in density, said immiscible lubricant is collected in said collection chamber.

15. A refrigeration system comprising:

(a) an evaporator;

(b) a compressor connected to said evaporator;

(c) a condenser connected to said compressor;

(d) an expansion device connected to said condenser and to said evaporator, said connection between said condenser and said expansion device comprising a liquid refrigerant flow line;

(e) a means for reducing the speed of the flow of fluid between said condenser and said expansion device, such that said liquid refrigerant and immiscible lubricant flow through said means at a speed and for a period of time sufficient to permit said liquid refrigerant and said immiscible lubricant to at least partially separate based upon their differences in density; and (f) a collection chamber for separated immiscible lubricant, said collection chamber being in fluid communication with said speed reducing means and vertically displaced from said means for collecting said immiscible lubricant.

* * * * *